US005382013A

United States Patent [19]

Walsh

[11] Patent Number: 5,382,013

[45] Date of Patent: Jan. 17, 1995

[54] CLUTCH DRIVEN INVERTER SHAFT

[75] Inventor: James D. Walsh, Rochester, N.Y.

[73] Assignee: Xerox Corporation, Stamford, Conn.

[21] Appl. No.: 135,233

[22] Filed: Oct. 12, 1993

[51] Int. Cl.[6] ..... B65H 29/00

[52] U.S. Cl. ..... 271/186; 271/65; 271/902

[58] Field of Search ..... 271/65, 176, 186, 225, 271/265, 902

[56] References Cited

U.S. PATENT DOCUMENTS

| | | | |
|---|---|---|---|
| 4,486,012 | 12/1984 | Böck et al. | 271/176 X |
| 4,699,367 | 10/1987 | Russel | 271/902 X |
| 4,804,175 | 2/1989 | Grandjean | 271/176 X |
| 5,106,075 | 4/1992 | Wafford et al. | 271/186 |
| 5,228,680 | 7/1993 | Sugiura | 271/265 X |

FOREIGN PATENT DOCUMENTS

| | | | |
|---|---|---|---|
| 2020251 | 11/1979 | United Kingdom | 271/902 |

*Primary Examiner*—Robert P. Olszewski
*Assistant Examiner*—Boris Milef
*Attorney, Agent, or Firm*—Fay, Sharpe, Beall, Fagan, Minnich & McKee

[57] ABSTRACT

A paper inverter system includes a clutch driven inverter nip for maintaining a positive bi-directional contact with the sheet. The apparatus includes a pair of opposing rollers defining a nip therebetween and a shaft connected to at least one of the pair of opposing rollers. A spring is held stationary on a first end and is connected to the shaft on the other end for resisting the rotation of the shaft with a spring force. The clutch responsive to a control signal, selectively couples the shaft to a drive system against the spring force in a first rotational direction and decouples the shaft from the drive system for rotation in a second and opposite direction with the spring force. In another embodiment a clutch operates a planetary gear system to be bi-directionally control the nip.

24 Claims, 4 Drawing Sheets

CLUTCH DRIVEN INVERTER SHAFT

BACKGROUND OF THE INVENTION

The subject invention is directed to the art of paper sheet handling and, more particularly, to a clutch driven inverter shaft for use in a sheet inverter system.

The invention is especially suited for use in the paper handling and inverter system of an electrophotographic printing machine and will be described with reference thereto; however, as will become apparent, the invention could be used in many types of paper sheet handling systems in a variety of different machines.

In electrophotographic printing machines, it is sometimes necessary or desirable to flip or reverse the orientation of a moving paper sheet in a duplex processing operation to provide two-sided copying or for other reasons known to those skilled in the art. Such orientation changing is generally referred to as sheet "reversing" and has been accomplished in many different ways.

One prior art method of reversing has been to receive a first end of a moving sheet through a continuously moving roll nip and into an inverter against a reversing spring positioned between two opposing wire guides. The trailing or free end of the sheet is entirely pushed into the inverter by the nip only to be immediately expelled therefrom through an exit passage in the inverter. During this process, the sheet itself must entirely exit the nip and change direction abruptly. This leads to reliability problems especially for skewed sheet inputs and sheets having different weights, dimensions and textures. Also, the sheet edges are often damaged by engagement with the reversing spring during the inversion process.

It has been found desirable to develop a new and improved sheet inverter apparatus which overcomes the above noted problems and others encountered in the prior art. The present invention meets these needs and others and provides such an inverter which is simple, reliable fast and not likely to damage the documents handled therein.

SUMMARY OF THE INVENTION

The subject invention provides a simple and effective sheet inverter apparatus including a clutch driven inverter shaft which maintains positive drive on the moving sheets at all times.

Generally the subject invention comprises a bi-directional nip apparatus for use in an electrophotographic inverter system reversing the orientation of a moving sheet. The bi-directional nip includes a pair of opposing rollers defining a nip therebetween. A shaft is connected to at least one of the pair of opposing rollers. In one embodiments a mechanical energy storage mechanism is operatively connected to the shaft for storing energy during rotation of the shaft in a first direction and expending stored energy to rotate the shaft in the opposite direction. A suitable operatively associated external drive mechanism is connected to the shaft for motivating a rotation of the shaft in the first direction against the spring force. A clutch is provided for selectively alternately coupling and uncoupling the drive mechanism to the shaft against the spring force. By these means a sheet is drawn into the nip under the power of the drive mechanism with the clutch engaged, and expelled from the nip with the clutch disengaged using the energy stored in the spring connected to the shaft. Contact is maintained between the sheet and the nip at all times during this operation. In another embodiment, a software controlled planetary clutch driven inverter shaft operates in a first direction to pull the sheet into the nip and in a second direction to push the reversed sheet outward. The planetary clutch driven inverter shaft maintains positive contact with the moving sheet at all times during the reversal process.

In the first embodiment of the present invention, the mechanical energy storage mechanism is preferably a coil spring held stationary on a first end, and connected to the shaft on its other end for resisting rotation of the shaft in the first direction with a spring force.

Further, the first embodiment of the present invention does not require the use of the reversing spring contacting the paper edge often found in most prior art systems. As indicated above, this spring oftentimes damages or otherwise affects the quality of the moving paper sheets in the duplex processing operation.

Still further because the above-described clutch arrangement alternately powers the shaft first with the operatively associated drive mechanism and then with the coil spring, it is possible to forgo use of expensive servo drives, reversing motors; or other complicated apparatus. Rather, the subject invention is powered by a single unidirectional external drive mechanism.

In accordance with a further aspect of the first embodiment of the invention, there is provided a method of operating a bi-directional nip including first and second opposing rollers. The method comprises driving the first roller in a first rotational direction through a first angular displacement using an operatively associated drive member. Simultaneous with driving the first roller in the first rotational direction, energy is stored in a spring operatively associated with the first roller. The energy corresponds proportionately to a first angular displacement of the first roller. The method further comprises the step of driving the first roller in a second rotational direction opposite the first rotational direction through at least the first angular displacement using the energy stored in the spring.

As a further aspect of the invention, the method described above includes the steps of coupling the operatively associated drive member to the first roller to drive the first roller in the first rotational direction through the first angular displacement. Next, the drive member is decoupled or otherwise released from the first roller which is driven in the second rotational direction using the energy stored in the spring.

In accordance with yet another aspect the leading edge of a moving paper sheet is detected electronically upstream of the nip in order to coordinate the operations of the bi-directional nip with other components of the electrophotographic inverter apparatus.

In accordance with still a further aspect of the invention, there is provided a method of operating a bi-directional nip including first and second opposing rollers. The method comprises driving the first roller in a first rotational direction through a first angular displacement using an operatively associated planetary gear mechanism or other suitable transmission and operatively associated drive member. The method further comprises the step of driving the first roller in a second rotational direction opposite the first rotational direction through at least the first angular displacement by selectively clutching the transmission or planetary gear mechanism.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

While the present invention will be described hereinafter in connection with the preferred embodiments thereof, it will be understood that the description is not intended to limit the invention to those embodiments. On the contrary, it is intended to cover all alternatives, modifications and equivalents as may be included in the spirit and scope of the invention as defined by the appended claims.

Figure 1:
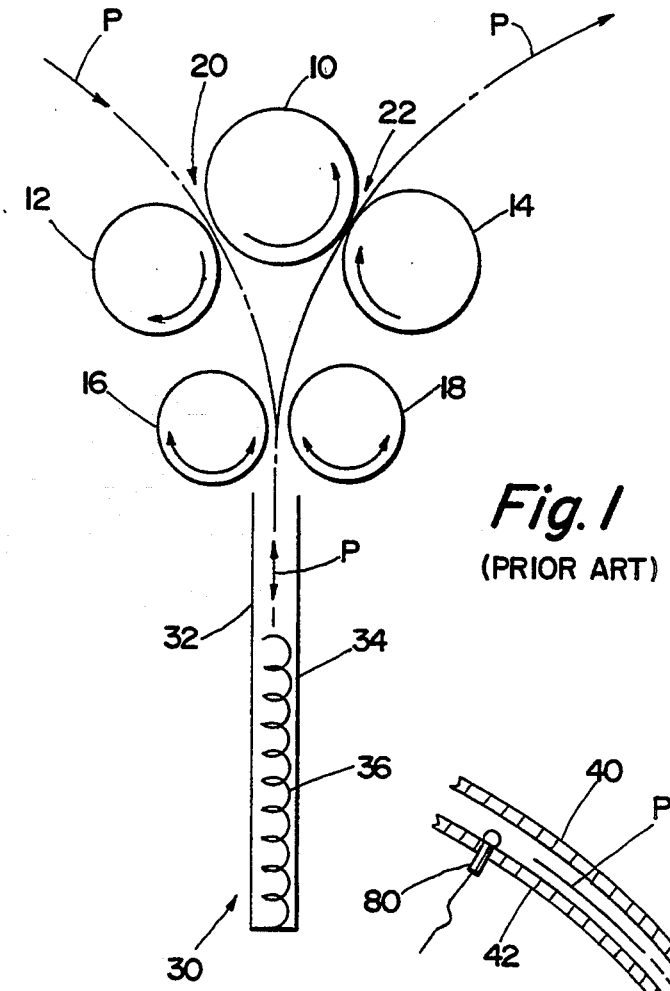
Fig. 1 (PRIOR ART)
FIG. 1 is a schematic elevational view of a prior art inverter.

By way of background a prior art inverter system is illustrated in FIG. 1 of the drawings. Broadly, as illustrated in FIG. 1, earlier inverter systems generally comprise guide means 24-27 which define a predetermined course of paper movement or path indicated generally by the dot and dash line P. In use, sheets are directed to a first pair of vertically positioned rolls 10 and 12. The rolls 10 and 12 are positioned in opposed relationship to define a first drive nip 20. Most commonly, only one of the rolls 10 or 12 is positively driven in the direction marked. As indicated in the figure, roll 10 is driven, whereas roll 12 is merely an idler roller Similar to the first drive nip 20, a pair of rolls 10 and 14 are positioned in opposed relationship to define a second drive nip 22. Like the roll 12 the roll 14 is merely an idler roller.

An inverting station 30 includes a spaced pair of respective left and right guide panels 32 and 34, respectively, which direct the sheet to a first vertically disposed reversing spring 36.

In use, a sheet is received into the first drive nip 20 and fed along the path P by the roller 10 whereupon the sheet leading edge contacts the spring 36 in the inverting station 30. The size of the inverting station itself is selected according to the intended sheet size such that after passing completely into and through the first drive nip 20, the trailing edge of the sheet is bent or curled toward the second drive nip by continuous contact with the roll 10. At that point the sheet is then expelled from the inverter system through the second drive nip 22 by the rotational motion of the driven roller 10. In this type of prior art system the spring 36 is used to ensure that the trailing edge of the sheet maintains contact with the roll 10 in order that it is deflected from the first drive nip 20 to the second drive nip 22 commensurate with the motion of the roller 10. A number of additional rolls may be included in basic inverter systems including first and second corragator rolls 16 and 18 as illustrated in the figure. These additional rolls have heretofore been non-powered.

Figure 2:
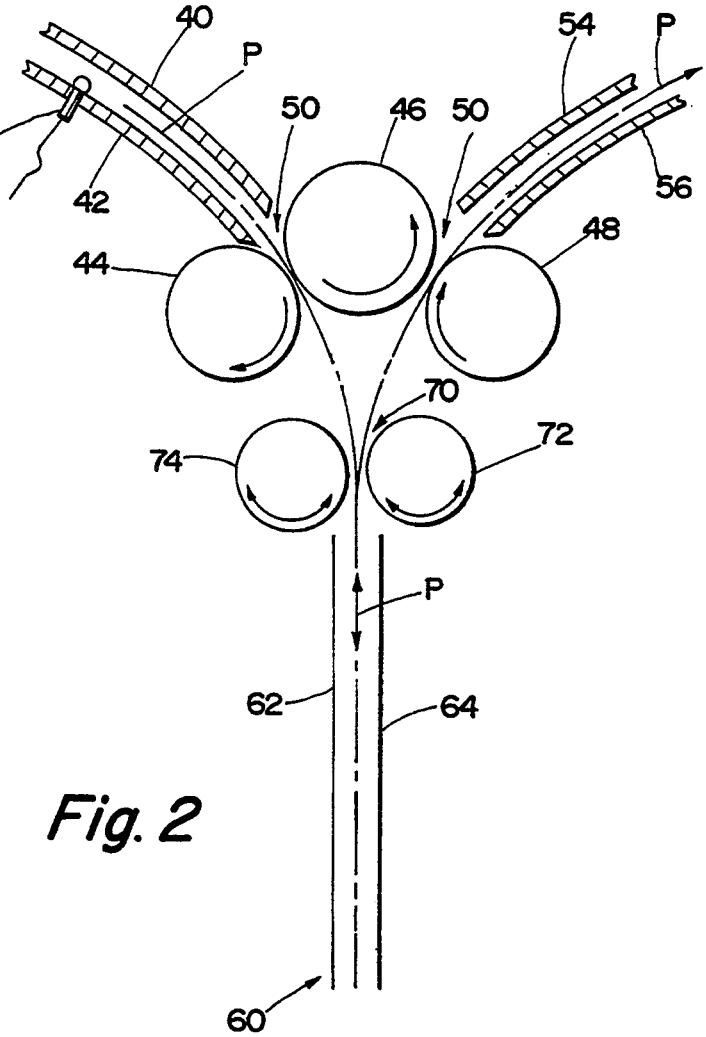
FIG. 2 is a schematic elevational view of an inverter using the clutch driven inverter shaft mechanism of the preferred embodiment.
Figure 3:
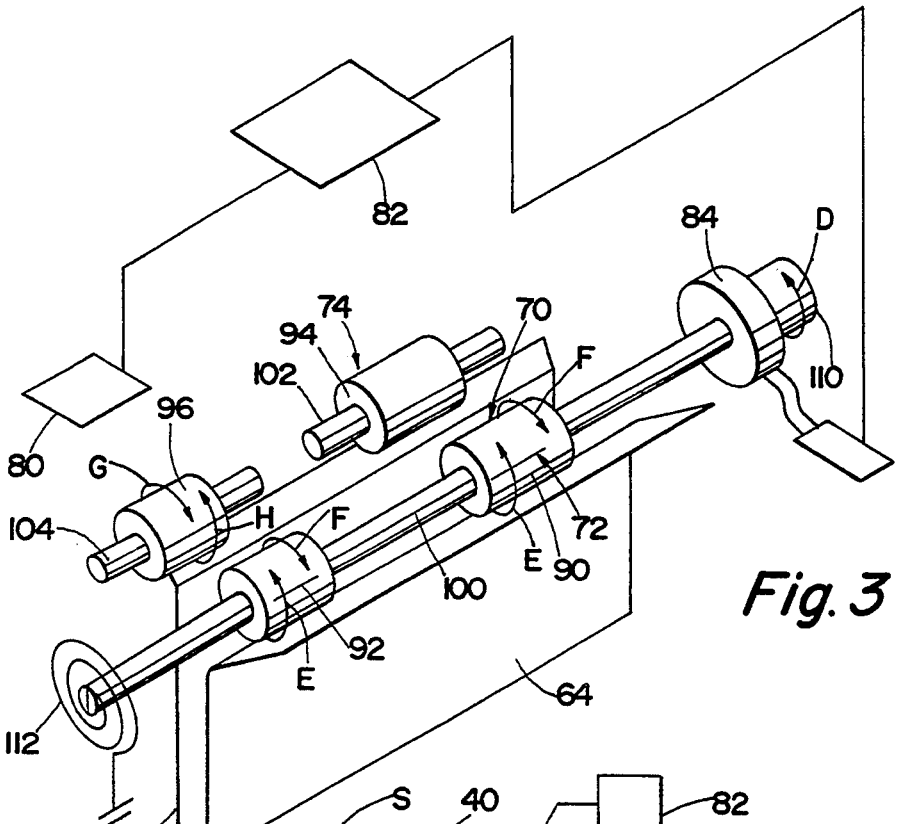
FIG. 3 is a schematic perspective view of a portion of the inverter of FIG. 2, with detail added illustrating the first embodiment of the present invention.

For a general understanding of the features of the instant invention having just discussed a popular prior inverter system, the preferred embodiment is best shown in FIGS. 2 and 3 of the drawings. In the drawings to follow, like reference numerals and primed (') reference numerals have been used throughout to designate identical or equivalent elements in the various embodiments. Also, the drawings are intended to illustrate the features of the present invention and are therefore not necessarily to scale. FIG. 2 schematically depicts an inverter system having a clutch driven inverter shaft according to the invention incorporated therein. The system shown in the FIGURES is specifically intended for use in an electrophotographic printing machine; however, the apparatus and system could clearly be used in a variety of other types of equipment incorporating sheet handling and transport systems.

Broadly, as illustrated in FIG. 2, the inverter with clutch driven shaft comprises a series of guide means which define a predetermined course of paper movement or path indicated generally by the dot and dash line P. In the preferred embodiment, the first guide means comprise a spaced pair of respective upper and lower guide panels 40 and 42, respectively which direct sheets to a first pair of horizontally positioned rolls 44 and 46. Among these, the roll 46 is driven by an operatively associated external drive member in the direction shown. The rolls 44 and 46 are positioned in opposed relationship to define a first drive nip 50. The first drive nip 50 is used to direct incoming sheets into the inverting station 60.

An exit drive nip 52 is defined by a pair of exit rolls 46 and 48 positioned in opposed relationship as illustrated in the FIGURE. As with roll 44, the roll 48 is non-powered and merely rotates with the driven roll 46. An exit chute comprises a spaced pair of respective upper and lower exit guide panels 54 and 56 respectively, which direct the inverted sheets to subsequent downstream electrophotographic operations.

As understood by those skilled in the art, the first drive nip 50 and the exit drive nip 52 may be replaced by a suitable arrangement of flip gates. At the entrance substituted for the first drive nip 50, a first flip gate would be biased in a closed position such as by gravity, a spring or the like until urged into an opened position by the leading edge of the paper sheet against the underside thereof After the sheet completely passes under the first flip gate and into the inverting station 60 of the invention, the gate closes by the spring force or by gravity whereupon the back side hereof is used to direct the sheet outward through the exit guide panels 54 and 56.

The inverting station 60 is located downstream of a clutch driven inverter nip 70 which will be described in greater detail below. The inverting station 60 preferably includes a pair of left and right paper guides 62 and 64, respectively for maintaining the sheet in a vertical orientation as it passes into and out of the clutch driven inverter nip 70. The guides are preferably flat panels but may be formed of wire or other mesh type material.

Lastly, with reference yet to FIG. 2, a suitable electronic sheet sensor 80 is positioned upstream of the entrance rolls 44 and 46 to detect the presence of sheets entering the inverting station 60. Sheets passing under the sensor 80 are received into the entrance drive nip 50 and directed along the predetermined path of paper movement to the clutch driven inverter nip 70. A predetermined time period after the trailing edge of the sheet has cleared the sheet sensor 80 and entrance drive nip 50, the direction of rotation of the clutch driven inverter nip 70 is reversed, urging the sheet upward as viewed in the drawing and into the exit drive nip 52 whereupon the sheet is ejected from the inverter system, but in a reversed orientation or bottom side up profile.

With reference now to FIG. 3, a portion of the inverter system illustrated in FIG. 2 is shown in schematic perspective view. For reasons which will subsequently become apparent the sheet sensor 80 is connected to a main controller unit 82 which is suitably arranged for processing signals received by the sheet sensor. Also, the main controller unit includes means for generating at least one output signal for controlling a clutch member 84 responsive to that output signal to alternately engage and disengage the clutch input from the clutch output. In the preferred embodiment illustrated, the main controller unit 82 operates independent of the electrophotographic apparatus in a manner described below However, it is in within the intended scope of this invention to include hierarchical control over the clutch 84 and sheet sensor 80 by any of the various industrial or other control schemes including control dependent upon the intelligence resident in the electrophotographic apparatus itself.

As indicated above, the clutch driven inverter nip 70 includes a first driven roll 72 illustrated in the FIGURE as a pair of independent rollers 90 and 92 fixedly attached to a shaft 100. Correspondingly, the non-driven roll 74 is illustrated in this FIGURE as comprising a pair of independent rollers 94 and 96, each being loosely mounted on separate shafts 102 and 104 respectively. The rollers 94 and 96 are freely rotatable. Although the preferred embodiment includes idler-rollers, the nip 70 may be formed by positioning the shaft 100 and rollers 90, 92 in close proximity with a low fiction curvlinear surface.

The clutch 84 selectively connects the shaft 100 to a drive gear 110 which is in turn connected to operatively associated driving hardware in the electrophotographic machinery As indicated in the FIGURE, the drive gear 110 is unidirectionally rotated in the direction D causing the shaft 100 and rollers 90 and 92 thereon to also rotate in the direction E when the clutch 84 is engaged. When the clutch 84 is disengaged responsive to a control signal received from the main controller unit 82, the drive gear 110 continues to rotate in the direction D without influencing the shaft 100. Likewise, rotation of the shaft 100 is possible in either direction E or F while the clutch 84 is disengaged. This being the case, the operatively associated driving hardware connecting the clutch 84 to the electrophotographic machinery is preferably a low cost, high inertia unidirectional D.C. drive motor.

As illustrated in FIG. 3, the rollers 90 and 92 are preferably fixed to the shaft 100 which is not connected to either of the separate shafts 102 and 104. However, in some circumstances, it may be desirable to gear one or both of the separate shafts 102, 104 to the bi-directional shaft 100 for more positive drive on the paper sheets within the inverter. To accomplish this, a gear connected to the bi-directional shaft 100 between the coil spring 2 and the left and right wire guides 62, 64 would engage a corresponding gear similarly situated on the shaft 104. In this case, the roller 96 is fixed to the shaft 104 which is in turn rotatable on suitable bearing surfaces (not shown). Using this arrangement, rotation of the shaft 100 in the direction E causes the roller 96 to rotate in the direction G. Likewise, rotation of shaft 100 in the direction F causes rotation of roller 96 in the direction H.

Figure 4:
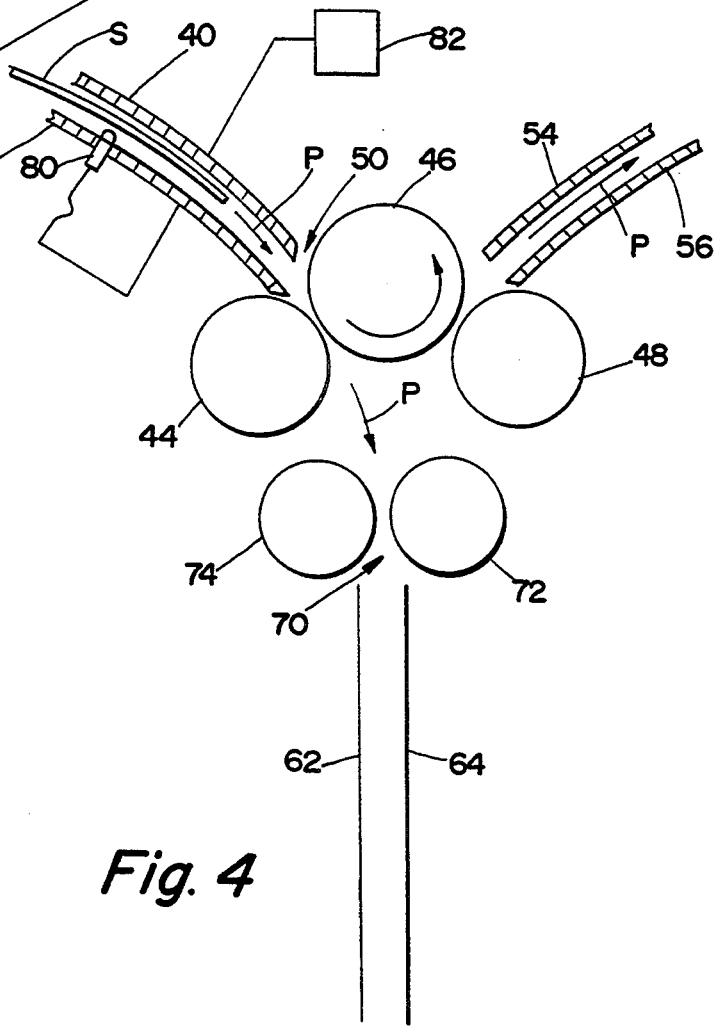
FIGS. 4 through 7 are schematic elevational views similar to FIG. 2, but showing the sequence of inverter steps in using the apparatus of FIG. 2; and, FIG. 8 is a schematic perspective view of a portion of the inverter of FIG. 2, with detail added illustrating the second embodiment of the present invention.

With reference now to FIGS. 2 and 3 in conjunction with FIGS. 4–7 in sequence, the operation of the clutch driven inverter shaft device of the present invention will be described in detail. First, a sheet S is received into the entrance upper and lower guide panels 40 and 42 respectively (FIG. 4). As the sheet passes proximate the sheet sensor 80, a signal is generated and received by the main controller unit 82. The signal represents the presence of the sheet S adjacent the sensor 80. A clutch signal is substantially simultaneously generated along with the signal from the sensor 80. The sheet S next progresses into the entrance drive nip 50 whereupon it is driven downwardly as viewed in the FIGURE into the clutch driven inverter nip 70. Both the entrance drive nip 50 and the clutch driven inverter nip 70 operate for a predetermined time after sensing the trailing edge of the sheet S. That is, they operate for a predetermined time after the signal from the sensor 80 as suspended. As described above, the clutch driven inverter nip 70 operates against the force of the coil spring 112 to in effect "wind" the spring storing mechanical energy. Obviously, other methods and apparatus are available to those skilled in the art for storing mechanical energy and are intended to be included herein. As an example of such alternative methods, the spring may be substituted with a weight constrained to vertical travel or a large lever arm or cylinder movable with the shaft 100.

Figure 5:
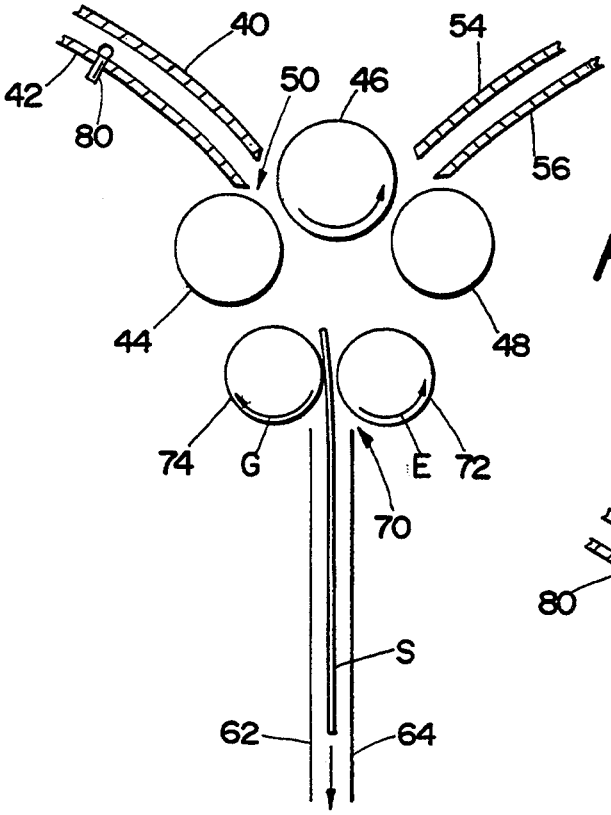
Figure 6:
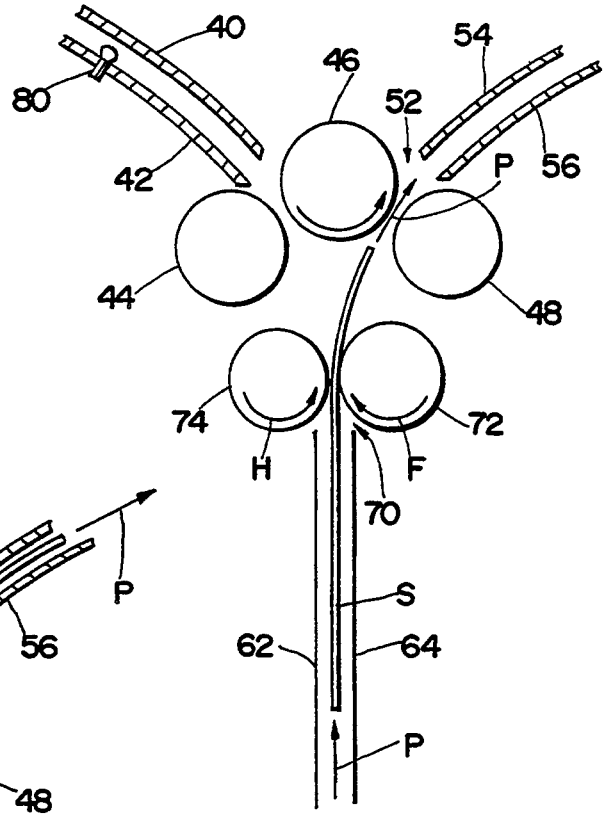

Just before the expiry of the predetermined time, as illustrated in FIG. 5, the trailing edge of the sheet S clears the entrance drive nip 50 while maintaining contact with the roll 46 until it is curled, urged or "paged" into the position illustrated in FIG. 6. According to the present invention, it is possible that the trailing edge of the sheet S loses contact with the roll 46. In this case, the sheet positively reestablishes the contact with the rotating roll 46 under the control of the clutch driven inverter shaft and roller.

The sheet S thus oriented is now appropriately positioned to be expelled from the inverter through the exit nip 52. This being so the clutch 84 is de-energized responsive to a control signal from the main controller unit 82. The coil spring or other suitable energy storage mechanism is thereby permitted to unwind or otherwise spend the energy earlier stored, urging the shaft 100 in the direction F. Although the bearing surface supporting the shaft 100 in the preferred embodiment provides the necessary dampening certain applications of the instant invention may require that the shaft 100 be further slightly dampened with a suitable dampener mechanism such as a viscous dampener or the like for example.

Figure 7:
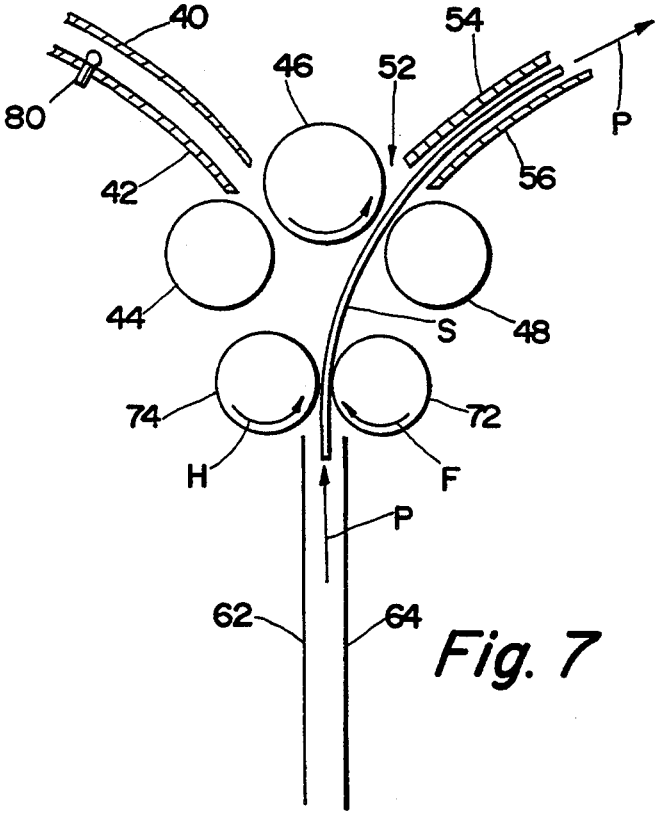

Next, as best illustrated in FIG. 7, the clutch driven inverter nip 70 is continuously operated under the influence of the coil spring 112 in the direction F drivingly urging the sheet S into the exit drive nip 52 and out of the inverter through the exit upper and lower guide panels 54 and 56 respectively. The spring 112 or other energy-storing apparatus generates the positive drive force F on the sheet through the shaft and rollers 90 and 92.

Figure 8:
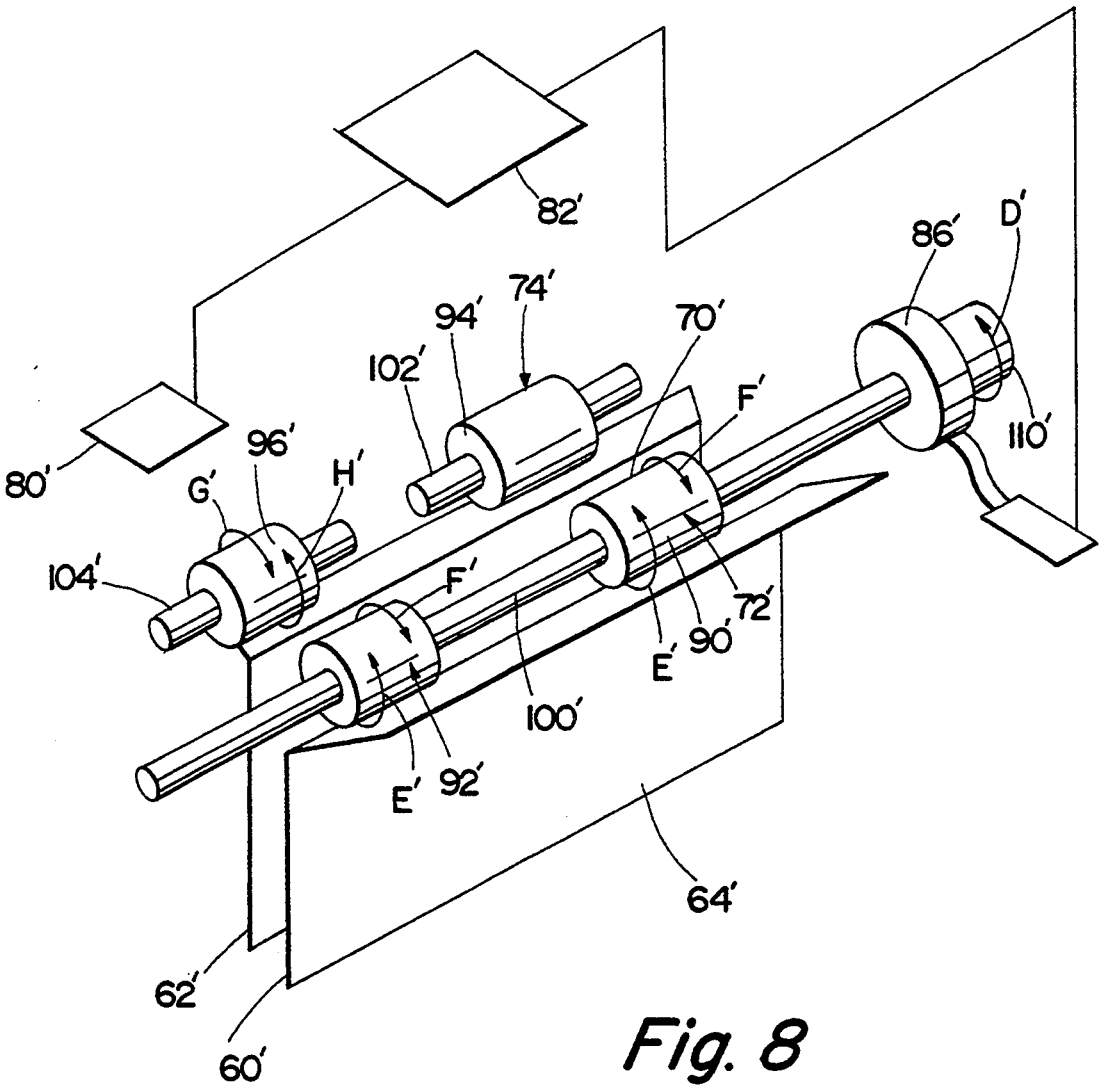

With reference now to FIG. 8 a portion of the inverter system illustrated in FIG. 2 comprising the second embodiment is shown in schematic perspective view. As with the first embodiment, the sheet sensor 80' is connected to a main controller unit 82' which is suitably arranged for processing signals received by the sheet sensor. Also, the main controller unit includes means for generating at least one output signal for controlling at least one clutch in a planetary gear mechanism 86 to alternately drive the shaft 100' in first and second rotational directions. Although this second embodiment includes a planetary system, other transmissions known to those skilled in the art are also applicable including fluid and belt drive systems. In the second embodiment illustrated, the main controller unit 82' operates independent of the electrophotographic apparatus in a manner described below. However, it is in within the intended scope of this invention to include hierarchical control over the planetary gear mechanism, clutch and sheet sensor 80' by any of the various industrial or other control schemes including control dependent upon the intelligence resident in the electrophotographic apparatus itself.

As above the clutch driven inverter nip 70' includes a first driven roll 72' illustrated in the FIGURE as a pair of independent rollers 90' and 92' fixedly attached to a shaft 100'. Correspondingly, the non-driven roll 74' is illustrated in this FIGURE as comprising a pair of independent rollers 94' and 96', each being loosely mounted on separate shafts 102' and 104' respectively. The rollers 94' and 96' are freely rotatable. Although embodiment also includes idler rollers, the nip 70' may be formed by positioning the shaft 100' and rollers 90', 92' in close proximity with a low fiction curvlinear surface.

The planetary gear mechanism 86 at all times positively connects the shaft 100' to a drive gear 100' which is in turn connected to operatively associated driving hardware in the electrophotographic machinery. The mechanism 86 includes at least one clutch therein for selectively changing the operating states of he planetary gearing using methods and apparatus known to those skilled in the art. As indicated in the FIGURE, the drive gear 100' is unidirectionally rotated in the direction D' causing the shaft 100' and rollers 90' and 92' thereon to also rotate in the direction E' when the at least one clutch within the planetary gears mechanism 86 is engaged in a first configuration. When the at least one clutch is disengaged responsive to a control signal received from the main controller unit 82', the drive gear 100' continues to rotate in the direction D' driving the shaft 100' in the direction F'. As in the first embodiment, the operatively associated continuous driving hardware D is preferably a low cost high inertia, unidirectional D.C., drive motor. Thus, the shaft 100' at all times rotates in a one of either a first or second direction. Therefore, nip "start up" lag time is never a problem.

With reference now to FIGS. 2 and 8 in conjunction with FIGS. 4–7 in sequence, the operation of the clutch driven inverter shaft device of the second embodiment of the present invention will be described in detail. First, a sheet S is received into the entrance upper and lower guide panels 40 and 42 respectively (FIG. 4). As the sheet passes proximate the electronic sheet sensor 80', a signal is generated and received by the main controller unit 82'. The sheet S next progresses into the entrance drive nip 50 whereupon it is driven downwardly as viewed in the FIGURE into the clutch driven inverter nip 70'. Both the entrance drive nip 50 and the clutch driven inverter nip 70' operate for a predetermined time in a first direction after sensing the trailing edge of the sheet S.

Just before the expiry of the predetermined time, as illustrated in FIG. 5, the trailing edge of the sheet S clears the entrance drive nip 50 while maintaining contact with the roll 46' until it is curled, urged or "paged" into the position illustrated in FIG. 6. According to the present invention, it is possible that the trailing edge of the sheet S loses contact with the roll 46. In this case, the sheet positively reestablishes the contact with the rotating roll 46 under the control of the clutch driven inverter shaft and roller. Also, flip gates may be used in place of the entrance and exit drive nips 50, 52 respectively.

The sheet S thus oriented is now appropriately positioned to be expelled from the inverter through the exit nip 52. This being so, the at least one clutch within the planetary gear mechanism 86 is deenergized responsive to a control signal from the main controller unit 82' urging the shaft 100' in the direction F'. An advantage of this second embodiment using the planetary gear mechanism 86 is that little or no dampening is required to bi-directionally operate shaft 100'. Since the nip rollers 90', 92', 94' and 96' are in positive engagement with the driving member D' through the planetary gear mechanism at all times, control over slippage with the sheet S' is possible through proper selection of gearing. Furthers the mechanism 86 may include a plurality of gears selectable for various paper physical characteristics using a plurality of clutches or other well known mechanisms Next, as best illustrated in FIG. 7 the clutch driven inverter nip 70' is continuously operated under the influence of the planetary gear mechanism 86 in the direction F' drivingly urging the sheet S into the exit drive nip 52 and out of the inverter through the exit upper and lower guide panels 54 and 56 respectively. The continuous driving member D' generates the positive drive force F' on the sheet through the planetary gear mechanism 86 and the shaft and rollers 90' and 92'.

The invention has been described with reference to the preferred embodiment. Obviously, modifications and alterations will occur no others upon a reading and understanding of his specification. It is intended to include all such modifications and alterations insofar as they come within the scope of the appended claims or the equivalents thereof.

Having thus described the invention, it is now claimed:

1. A method of operating an inverter apparatus for reversing the orientation of a moving paper sheet in a duplex processing operation, the method comprising the steps of:

detecting a lead edge of said moving sheet and generating a START signal;

receiving said lead edge of said moving sheet into a first continuously driven nip including a first continuously driven main drive roller and a first idler roller;

responsive to said START signal, operating a first selectively driven nip in a first direction;

receiving said lead edge of said moving sheet into said first selectively driven nip;

detecting the trailing edge of said moving sheet and disabling said START signal;

responsive to said START signal disabling, operating said first selectively driven nip in a second direction opposite the first direction;

receiving said trailing edge of said moving sheet into a second continuously driven nip including said first continuously driven main drive roller and a second idler roller;

expelling said sheet from said second continuously driven nip in said reversed orientation; and, providing a clutched transmission connecting the first selectively driven nip with an operatively associated external continuously driven source of rotational motion.

2. The method according to claim 1 wherein:

the step of operating the first selectively driven nip in the first direction includes the step of operating a clutch mechanism of the transmission into a first state; and, the step of operating the first selectively driven nip in the second direction includes the step of operating said clutch mechanism of the transmission into a second state.

3. A method of operating an inverter apparatus for reversing the orientation of a moving paper sheet in a duplex processing operation, the method comprising the steps of:

detecting a lead edge of said moving sheet and generating a START signal;

receiving said lead edge of said moving sheet into a first continuously driven nip including a first continuously driven main drive roller and a first idler roller;

responsive to said START signal, operating a first selectively driven nip in a first direction by engaging a clutch to connect the first selectively driven nip with an operatively associated external continuously driven source of rotational motion;

receiving said lead edge of said moving sheet into said first selectively driven nip;

detecting the trailing edge of said moving sheet and disabling said START signal;

responsive to said START signal disabling operating said first selectively driven nip in a second direction opposite the first direction;

receiving said trailing edge of said moving sheet into a second continuously driven nip including said first continuously driven main drive roller and a second idler roller; and, expelling said sheet from said second continuously driver, nip in said reversed orientation.

4. The method according to claim 3 wherein the step of operating the first selectively driven nip in the second direction includes the step of disengaging said clutch to disconnect the first selectively driven nip from the operatively associated continuously driven source of rotational motion.

5. The method according to claim 4 wherein the step of operating the first selectively driven nip in the first direction includes the step of winding a spring connected to the first selectively driven nip.

6. The method according to claim 5 wherein the step of operating the first selectively driven nip in the second direction includes the step of unwinding said spring connected to the first selectively driven nip.

7. The method according to claim 6 wherein the step of operating the first selectively driven nip in the second direction responsive to the START signal disenabling includes the step of delaying said operating of the first selectively driven nip for a predetermined time.

8. A bi-directional nip apparatus for use in an inverter reversing the orientation of a moving sheet the nip comprising:

a pair of opposing rollers defining a nip therebetween;

a shaft connected to at least one of the pair of opposing rollers;

a spring means held stationary on a first end and connected to the shaft on the other end, for resisting rotation of said shaft with a spring force drive means for motivating a rotation of said shaft; and, clutch means, responsive to a first signal for selectively coupling the drive means to the shaft against the spring force.

9. The bi-directional nip apparatus according to claim 8 wherein said drive means is unidirectional for motivating a unidirectional rotation of said shaft.

10. The bi-directional nip apparatus according to claim 8 further comprising sensing means for sensing said moving sheet upstream of said pair of opposing rollers and generating a second signal in a presence of said sheet at the sensing means and suspending generation of the second signal in an absence of said sheet at the sensing means.

11. The bi-directional nip apparatus according to claim 10 further comprising control means, connected to said sensing means and to said clutch means, for i) generating said first signal substantially simultaneous with the generation of said second signals and ii) suspending generation of said first signal a predetermined time period after said second signal is suspended.

12. A bi-directional nip apparatus for use in an inverter reversing the orientation of a moving sheet, the nip comprising:

a first surface and an opposing roller defining a nip therebetween;

a rotatable shaft connected to the roller;

energy storage means connected to the shaft for storing energy absorbed during rotation of said shaft; and, clutch means, responsive to a first signal, for selectively coupling and uncoupling an operatively associated external drive means other than said moving sheet to the rotatable shaft.

13. The bi-directional nip apparatus according to claim 12 wherein said drive means is unidirectionally continuously driven by an operatively associated external power member.

14. A method of reversing the orientation of a moving sheet in a bi-directional nip including first and second opposing rollers, the method comprising the steps:

driving the first roller in a first rotational direction through a first angular displacement using an operatively associated drive member other than said moving sheet;

simultaneous with said first rotational direction roller driving step, storing energy in a spring operatively connected to the first roller, the energy corresponding to said first angular displacement of said first roller; and, driving the first roller in a second rotational direction opposite said first rotational direction through said first angular displacement using the energy stored in said spring.

15. The method according to claim 14 wherein said step of driving the first roller in the second rotational direction is performed by the energy snored in said spring exclusive of said operatively associated drive member.

16. The method according to claim 14 further comprising the steps of:

coupling the operatively associated drive member no the first roller to drive the first roller in said first rotational direction through said first angular displacement; and, decoupling the operatively associated drive member from the first roller to drive the first roller in said second rotational direction using said energy stored in said spring.

17. A bi-directional nip apparatus for use in an inverter reversing the orientation of a moving sheet, the nip comprising:

a first surface and an opposing roller defining a nip therebetween;

a rotatable shaft connected to the roller energy storage means for storing energy absorbed during rotation of said shaft; and, clutch means, responsive to a first signal, for selectively coupling and uncoupling an operatively associated external drive means to the rotatable shaft.

18. The bi-directional nip apparatus according to claim 17 wherein the energy storage means comprises a spring means, held stationary on a first end and connected to the shaft on the other end, for resisting rotation of said shaft with a spring force.

19. A method of flipping a sheet in a bi-directional nip including a paper contacting surface, the method comprising the steps of:

driving the paper contacting surface in a first direction through a first displacement using an operatively associated drive member other than said sheet;

simultaneous with said paper contacting surface driving step, storing energy in an energy storage means operatively connected to the paper contacting surface, the energy corresponding to said first displacement of said paper contacting surface; and, driving the paper contacting surface in a second direction opposite said first direction through said first displacement using the energy stored in said energy storage means.

20. The method according to claim 19 wherein said step of driving the paper contacting surface in the second direction is performed by the energy stored in said energy storage means exclusive of said operatively associated drive member.

21. The method according to claim 19 further comprising the steps of:

coupling the operatively associated drive member to the paper contacting surface to drive the paper contacting surface in said first direction through said first displacement; and decoupling the operatively associated drive member from the paper contacting surface to drive the paper contacting surface in said second direction using said energy stored in said energy storage means.

22. An apparatus for reversing the orientation of a moving sheet comprising in combination:

a first continuously driven nip including a first continuously driven main drive roller and a first idler roller;

a second continuously driven nip including said first continuously driven main drive roller and a second idler roller;

a sensor for i) detecting a lead edge of said moving sheet and generating a START signal when the lead edge is detected and ii) detecting a trailing edge of said moving sheet and generating a STOP signal when the trailing edge is detected;

a bi-directional nip apparatus including:

a pair of opposing rollers defining a nip therebetween;

a shaft connected to at least one of the pair of opposing rollers;

a spring means, held stationary on a first end and connected to the shaft on the other end, for resisting rotation of said shaft with a spring force;

drive means for motivating a rotation of said shaft; and, a clutch responsive to a first signal for selectively coupling the drive means to the shaft against the spring force; and, a controller connected to the sensor and clutch and responsive to the START signal for selectively generating said first signal to draw the moving sheet into the bi-directional nip apparatus through the first continuously driven nip.

23. The apparatus according to claim 22 wherein said controller is responsive to the STOP signal for selectively suspending generation of said first signal to expel the moving sheet from the bi-directional nip apparatus through the second continuously driven nip.

24. The apparatus according to claim 23 wherein said controller includes means responsive to the STOP signal for selectively suspending generation of said first signal after a predefined time delay period to expel the moving sheet from the bi-directional nip apparatus through the second continuously driven nip.

* * * * *